US009522558B2

(12) United States Patent
Lee et al.

(10) Patent No.: US 9,522,558 B2
(45) Date of Patent: Dec. 20, 2016

(54) TAMPER AND ROTATABLE STAPLER FOR POST-PROCESSING DEVICE

(71) Applicant: KRDC CO., LTD., Seoul (KR)

(72) Inventors: Yong woo Lee, Seoul (KR); Myoung soo Kang, Seoul (KR)

(73) Assignee: KRDC CO., LTD., Seoul (KR)

( * ) Notice: Subject to any disclaimer, the term of this patent is extended or adjusted under 35 U.S.C. 154(b) by 0 days.

(21) Appl. No.: 14/941,353

(22) Filed: Nov. 13, 2015

(65) Prior Publication Data

US 2016/0068001 A1 Mar. 10, 2016

Related U.S. Application Data

(63) Continuation of application No. 13/949,046, filed on Jul. 23, 2013, now Pat. No. 9,186,925.

(30) Foreign Application Priority Data

Jun. 21, 2013 (KR) ..... 10-2013-0071722

(51) Int. Cl.
*B65H 37/04* (2006.01)
*B42C 1/12* (2006.01)
*B42B 4/00* (2006.01)

(52) U.S. Cl.
CPC .. *B42C 1/12* (2013.01); *B42B 4/00* (2013.01)

(58) Field of Classification Search
CPC ..... B65H 37/04; B42C 1/12; B42D 4/00
USPC ..... 270/58.08, 58.11; 399/410
See application file for complete search history.

(56) References Cited

U.S. PATENT DOCUMENTS

| | | | | |
|---|---|---|---|---|
| 5,060,922 | A * | 10/1991 | Shibusawa | B42B 4/00 270/58.09 |
| 6,341,772 | B1 | 1/2002 | Waragai et al. | |
| 6,382,614 | B1 | 5/2002 | Fukatsu et al. | |
| 6,561,503 | B1 | 5/2003 | Ogata et al. | |
| 7,747,212 | B2 * | 6/2010 | Yamamoto | B65H 9/101 270/58.08 |
| 8,720,880 | B2 * | 5/2014 | Awano | B65H 31/38 270/58.07 |
| 8,950,746 | B2 * | 2/2015 | Takemasa | B65H 29/00 271/240 |
| 9,186,925 | B2 * | 11/2015 | Lee | B42C 1/12 |
| 2010/0289205 | A1 * | 11/2010 | Taki | B65H 31/02 270/58.08 |

* cited by examiner

*Primary Examiner* — Patrick Mackey
(74) *Attorney, Agent, or Firm* — Birch, Stewart, Kolasch & Birch, LLP

(57) ABSTRACT

An apparatus for post-processing sheets which is installed at a discharge end of a longitudinal discharge type image forming apparatus includes a tamper which arranges opposite ends of one side of a longitudinal direction of a sheet stack discharged from the discharge end in a first direction and stacked as many as a preset number of sheets, and transfers the arranged sheet stack in a second direction perpendicular to the first direction; and a sheet post-processing unit which performs post-processing in parallel with a longitudinal end of the sheet stack transferred in the second direction by the tamper or performs post-processing while being rotated by an arbitrary angle with respect to a corner end portion of the sheet stack.

13 Claims, 16 Drawing Sheets

TAMPER AND ROTATABLE STAPLER FOR POST-PROCESSING DEVICE

CROSS-REFERENCE TO RELATED APPLICATION

This application is a Continuation application of U.S. application Ser. No. 13/949,046, filed Jul. 23, 2013, which claims priority from Korean Application No. 10-2013-0071722, filed Jun. 21, 2013, the subject matters of which are incorporated herein by reference.

BACKGROUND OF THE INVENTION

1. Field of the Invention

The present invention relates to an apparatus for post-processing sheets which is installed at a sheet discharge end of a longitudinal discharge type image forming apparatus, such as a duplicator, a printer, and a facsimile, in which the sheets are transferred in a longitudinal direction (a lengthwise direction of the sheets), arranges in a temporary storage space the longitudinal sheets on which images have been formed, and performs post-processing such as stapling of the arranged sheets, and more particularly to an apparatus for post-processing sheets which performs an stapling operation in a transfer direction in a process of transferring a sheet stack arranged in a temporary storage space.

2. Description of the Prior Art

In general, an image forming apparatus has one or two or more of a copy function, a print function, and a fax function according to a recent development from an analogue method to a digital method, and a digital type image forming apparatus can selectively discharge image-formed sheets from the apparatus itself.

An analogue type image forming apparatus of the related art discharges the sheets whenever a required number of documents are sequentially fed into the apparatus through an automatic document feeder over and over again, and multiple sheet receiving trays installed in a sheet post-processing apparatus for arranging the sheets differentially receive the discharged sheets while moving upward and downward.

However, the digital type image forming apparatus stores image information to be copied or recorded in a main body, and then records the image information on sheets in an order desired by a user to discharge the sheets. Accordingly, a sheet post-processing apparatus having a structure in which the sheets are differentiated and received without the multiple sheet receiving trays is being proposed.

For example, when a user wants to copy or record a multipage document many times, the main body of the image forming apparatus records image information of the multipage document on sheets and discharges the sheets in a serial order over and over again, and such a new sheet post-processing apparatus, including a sheet receiving tray for temporarily receiving the sheets until a stack of sheets is completely discharged, performs post-processing such as stapling of the sheets if necessary when the stack of sheets is completely discharged and then stores the sheets in one tray having a stacker function.

At this time, the sheet receiving tray for temporarily receiving the sheets requires a function of the post-processing such as stapling to be performed if necessary, when the stack of sheets is completely discharged or a sheet arrangement function for allowing the sheets to be received in an arranged state, and the one tray having the stacker function requires an offset function for differentially storing sheet stacks in zigzags such that the post-processed sheet stack is stored differentially from a next discharged sheet stack.

Such a new sheet post-processing apparatus has been proposed in Japanese Patent No. H08-941 and Japanese Patent No. 2583594, and will be described with reference to FIGS. 1 and 2.

As shown in FIG. 1, a sheet post-processing apparatus is mounted to a sheet discharge hole 2 side of an image forming apparatus 1 such as a duplicator, a facsimile, and a printer. An ejected sheet on which an image has been formed is discharged to a sheet discharge hole 9 of the sheet post-processing apparatus through a sheet transfer unit 4. First, the discharged sheet is received in an inclined arrangement tray 5, and an inner side end of the sheet is supported by a sheet push unit 8 located on an inclined lower surface of the arrangement tray 5 to be arranged. At this time, the sheet received in the arrangement tray 5 is moved toward the inclined lower surface through a conveying belt 7 such that the inner side end of the sheet is more accurately arranged. When a stack of sheets is completely discharged through repetition of the above-described process, a solenoid 5 *a* connected to the arrangement tray 5 operates to arrange a side surface of the received sheet stack, and post-processing of the sheets is performed through an operation of a stapler 10 in a state in which the sheets have been arranged. Thereafter, the sheet push unit 8 supporting the lower surfaces of the sheets is moved forward by a sheet push motor 8 *a* so that the sheets are received in a receiving tray 6.

As shown in FIG. 3, in the sheet post-processing apparatus of the related art, a stapler 10 is generally installed at a leading end portion or a trailing end portion of the sheets in a discharge direction, and performs stapling while crossing a discharge path of the sheets. FIG. 3A shows a state in which a stapler 10 performs stapling at a trailing end portion of longitudinally transferred sheets (sheets in which a lengthwise direction corresponds to a transfer direction) while crossing a discharge path of the sheets, and FIG. 3B shows a state in which a stapler 10 performs stapling at a trailing end portion of laterally transferred sheets (sheets in which a lengthwise direction corresponds to a direction perpendicular to a transfer direction) while crossing a discharge path of the sheets.

FIG. 3A and FIG. 3B show examples of multipoint stapling in the sheet post-processing apparatus mounted to a main body capable of transferring large-sized sheets, for example, A3 size sheets or double-letter size sheets.

However, in a case of a main body capable of transferring only small-sized sheets, for example, A4 size sheets or sheets having a size equal to or smaller than letter size, the sheets can be transferred only in a longitudinal direction (a lengthwise direction of the sheets), and a sheet post-processing apparatus mounted to the main body can perform only one-point stapling at a leading end portion or a trailing end portion of the sheets as shown in FIG. 3A.

Accordingly, the sheet post-processing apparatus mounted to the main body capable of transferring the small-sized sheets only in the longitudinal direction cannot bind the sheet stack like a book.

SUMMARY OF THE INVENTION

Accordingly, the present invention has been made to solve the above-mentioned problems occurring in the prior art, and an object of the present invention is to provide an apparatus for post-processing sheets which is installed at a sheet discharge end of an image forming apparatus, such as a small-sized duplicator, a small-sized printer, and a small-sized facsimile, in which sheets are transferred only in a longitudinal direction, to perform post-processing such as stapling of a sheet stack on which images have been formed, and more specifically performs multipoint binding (for example, two to five points of binding) while being parallel to a longitudinal transfer direction in a process of transferring a sheet stack, or one-point binding while being rotated by an arbitrary angle not to be parallel to a corner portion of a sheet stack.

In order to accomplish this object, there is provided an apparatus for post-processing sheets which is installed at a discharge end of a longitudinal discharge type image forming apparatus, and post-processes sheets which have been discharged by a preset number of sheets and arranged in a compiler which is a temporary storage space, the apparatus including: a sheet post-processing unit which is rotatably installed at one side of the compiler, and performs post-processing on a sheet stack, while being parallel to a longitudinal direction of the sheet stack which has been arranged according to a set value or being rotated by an arbitrary angle with respect to a corner end portion of the sheet stack; and a sheet stack transfer unit which transfers the sheet stack, which has been arranged in the compiler, in the same or an opposite direction to that in which the sheets have been discharged, while repeatedly moving and stopping the sheet stack by a preset number of times.

In accordance with another aspect of the present invention, there is provided an apparatus for post-processing sheets which is installed at a discharge end of a longitudinal discharge type image forming apparatus, and post-processes sheets which have been discharged by a preset number of sheets and arranged in a compiler which is a temporary storage space, the apparatus including: a sheet post-processing unit which is rotatably installed at one side of the compiler, and selectively performs multipoint binding at two to five points at a longitudinal end portion of a sheet stack which has been arranged in a longitudinal direction, or one-point binding at an angle between 1 and 90 degrees at a corner side of the sheet stack which has been arranged in the longitudinal direction, while being rotated according to a preset angle; and a sheet stack transfer unit which transfers the sheet stack, which has been arranged in the compiler, in the same or an opposite direction to that in which the sheets have been discharged, and stops transferring the sheet stack while the sheet post-processing unit performs post-processing.

The apparatus may further include a tamper which grasps the arranged sheet stack, and moves the sheet stack to a transfer path on which the sheet post-processing unit is located, when the sheets, which are discharged after images have been formed thereon in the longitudinal discharge type image forming apparatus, are arranged by the preset number of sheets in the temporary storage space.

As described above, the present invention provides an apparatus for post-processing sheets which locates the sheet post-processing unit at the one side of the longitudinal transfer path along which the sheet stack is transferred, and performs the post-processing (stapling) while intermittently transferring the arranged sheet stack through the sheet stack transfer unit, so that multipoint binding can be performed in the longitudinal direction of the sheet stack although the image forming apparatus transfers and discharges the sheets only in the longitudinal direction (a lengthwise direction of the sheets), which makes it possible to bind the sheets like a book.

Further, unlike the sheet post-processing apparatus according to the related art in which a post-processing unit performs post-processing such as stapling while being in motion, the sheet post-processing unit according to embodiments of the present invention is stationarily installed at a predetermined location of the transfer path to perform the post-processing in the process of transferring the sheet stack through the sheet stack transfer unit so that stability and accuracy can be secured according to the operation of the sheet post-processing unit.

Moreover, unlike the sheet post-processing apparatus according to the related art in which a post-processing unit performs post-processing such as stapling while crossing a transfer path of a sheet stack, the sheet post-processing unit according to embodiments of the present invention is rotated through a minimal movement, and then performs multipoint binding or one-point binding in a state of being stationary at a predetermined location in the longitudinal direction in which the sheet stack is transferred, so that a space can be minimally made for installation and an operation of the sheet post-processing unit 110.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Figure 1:
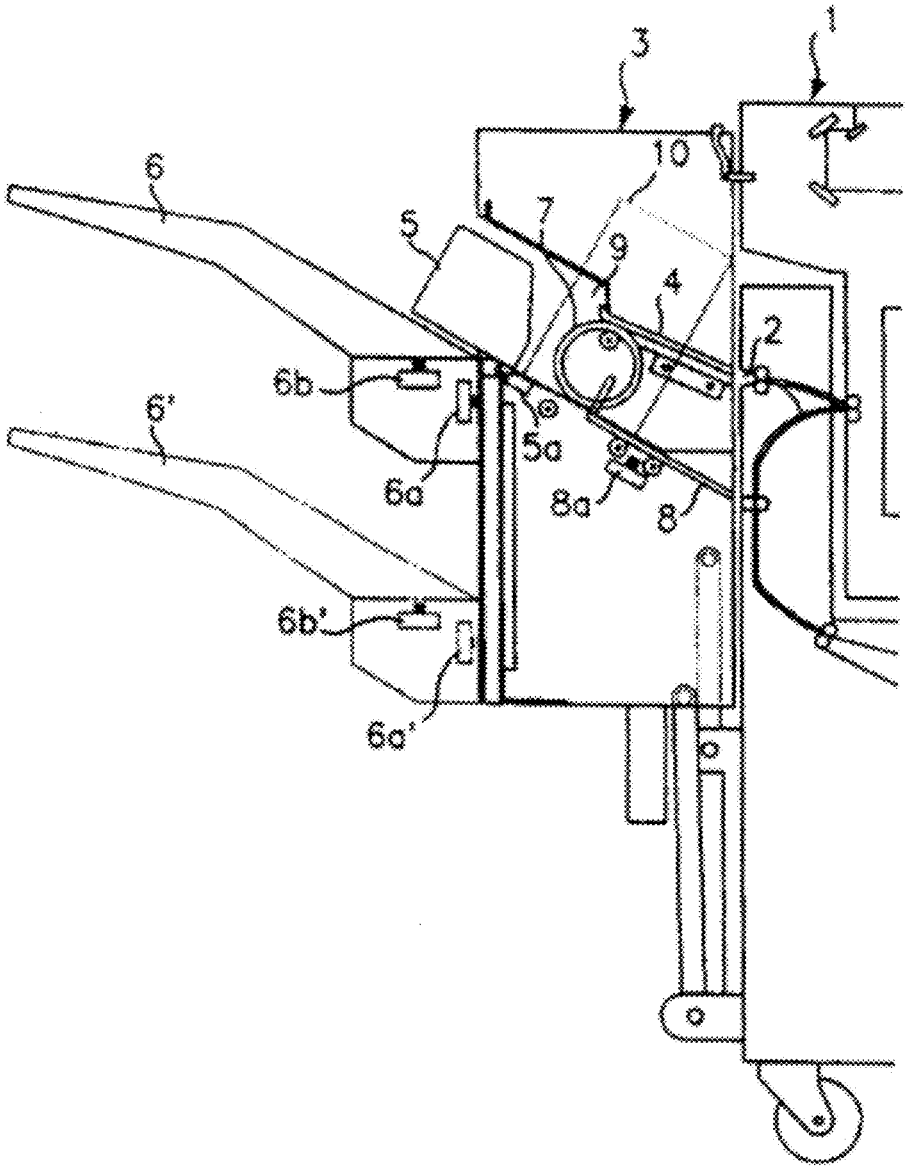
FIG. 1 is a side view showing a configuration of a sheet post-processing apparatus according to the related art.
Figure 2:
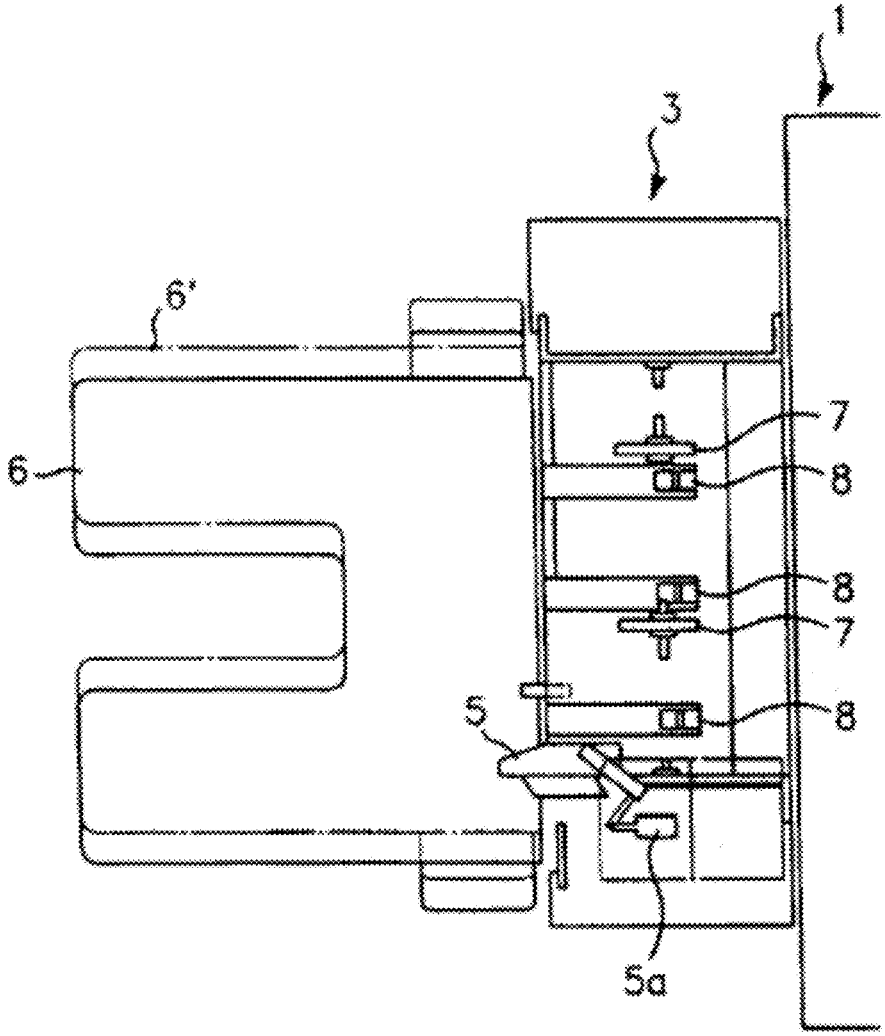
FIG. 2 is a plan view showing a configuration of a sheet post-processing apparatus according to the related art.
Figure 3:
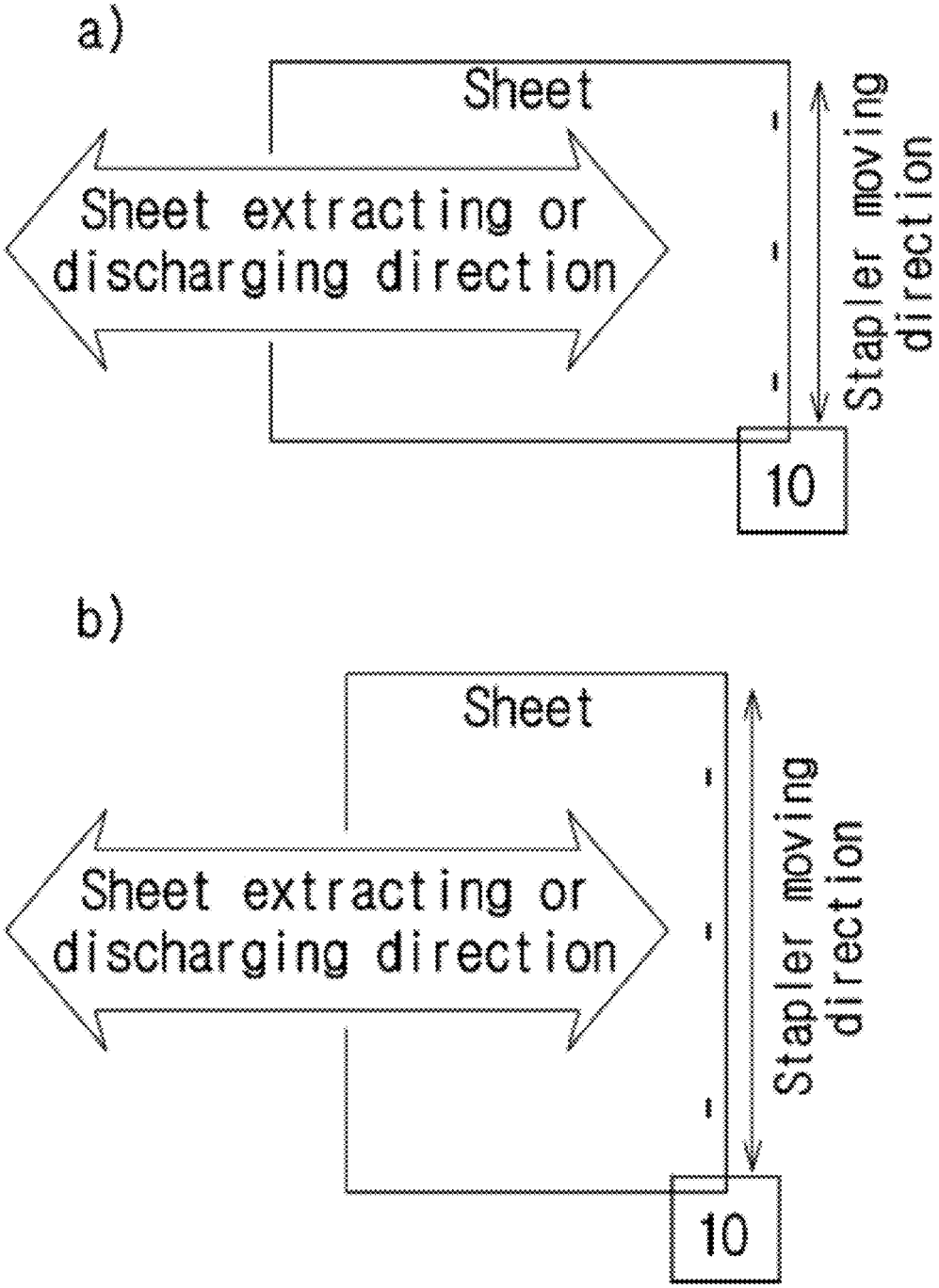
FIG. 3 shows schematic views exemplifying post-processing and transferring states of a sheet post-processing apparatus according to the related art.

Hereinafter, exemplary embodiments of the present invention will be described with reference to the accompanying drawings. In the following description and drawings, the same reference numerals are used to designate the same or similar components, and so repetition of the description on the same or similar components will be omitted.

Figure 4:
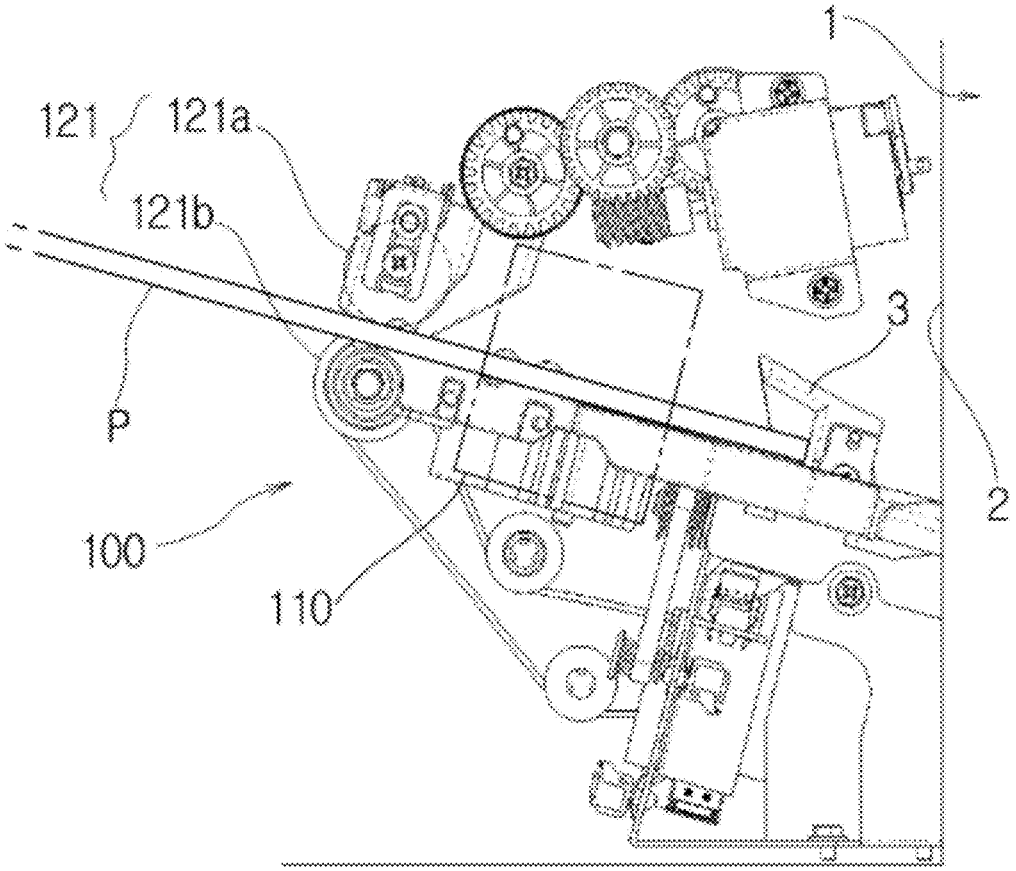
FIG. 4 is a side view showing a configuration of a sheet post-processing apparatus according to an embodiment of the present invention.
Figure 5:
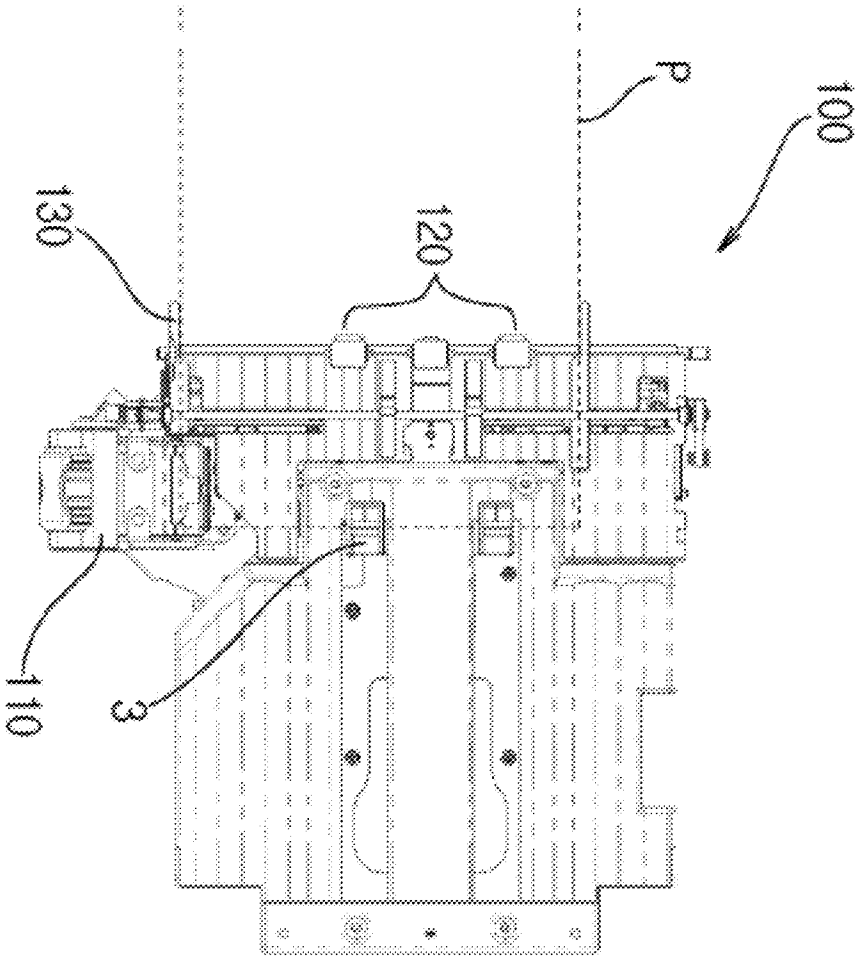
FIG. 5 is a plan view showing a configuration of a sheet post-processing apparatus according to an embodiment of the present invention.

As shown in FIGS. 4 and 5, a sheet post-processing apparatus 100 according to an embodiment of the present invention may be installed at a discharge end 2 of a longitudinal discharge type image forming apparatus 1 (an image forming apparatus in which sheets are discharged in a lengthwise direction thereof), and may post-process a sheet stack P which has been discharged by a preset number of sheets and arranged in a compiler which is a temporary storage space. The sheet post-processing apparatus 100 may include a sheet post-processing unit 110, and a sheet stack transfer unit 120. The sheet post-processing unit 110 may be rotatably installed at one side of the compiler, and perform post-processing on the sheet stack P while being parallel to the longitudinal direction of the sheet stack P which has been arranged according to a preset value, or being rotated by an arbitrary angle with respect to a corner end portion of the sheet stack P. The sheet stack transfer unit 120 may transfer the sheet stack P, which has been arranged in the compiler, in the same or an opposite direction to that in which the sheets have been discharged, while repeatedly moving and stopping the sheet stack P by a preset number of times.

Alternatively, a sheet post-processing apparatus 100 according to another embodiment of the present invention, which is installed at a discharge end 2 of a longitudinal discharge type image forming apparatus 1 (an image forming apparatus in which sheets are discharged in a lengthwise direction thereof), and post-processes a sheet stack P which has been discharged by a preset number of sheets and arranged in a compiler which is a temporary storage space, may include a sheet post-processing unit 110 which is rotatably installed at one side of the compiler and selectively performs multipoint binding at two to five points at a longitudinal end portion of the sheet stack P which has been longitudinally arranged, or one-point binding at an angle between 1 and 90 degrees at a corner side of the sheet stack P which has been longitudinally arranged, while being rotated according to a preset angle, and a sheet stack transfer unit 120 which transfers the sheet stack P, which has been arranged in the compiler, in the same or an opposite direction to that in which the sheets have been discharged, in which case the transfer of the sheet stack P is stopped during the post-processing of the sheet post-processing unit 110.

The image forming apparatus 1 to which the present invention is applied may be any one of a duplicator, a printer, a facsimile, and a multifunction printer capable of performing one or more combinations of copying, printing, and faxing, in which the sheets are discharged and transferred in the longitudinal direction thereof.

The sheet post-processing unit 110 may be a stapler for binding the sheet stack P containing two or more sheets.

Figure 6:
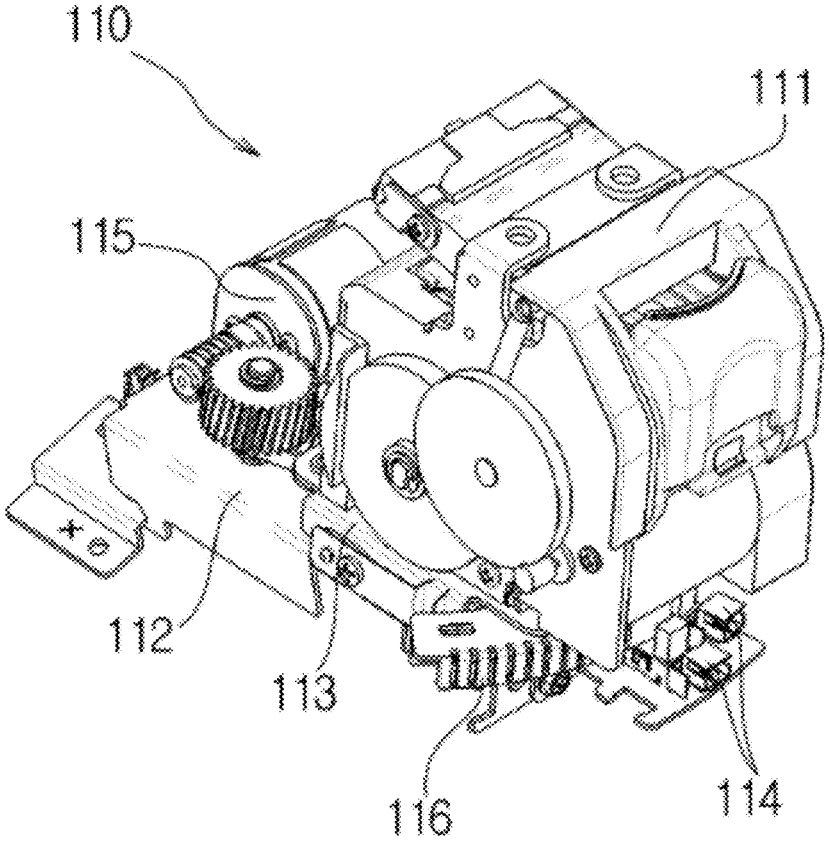
FIG. 6 is a perspective view showing a configuration of a sheet post-processing unit according to an embodiment of the present invention.
Figure 7:
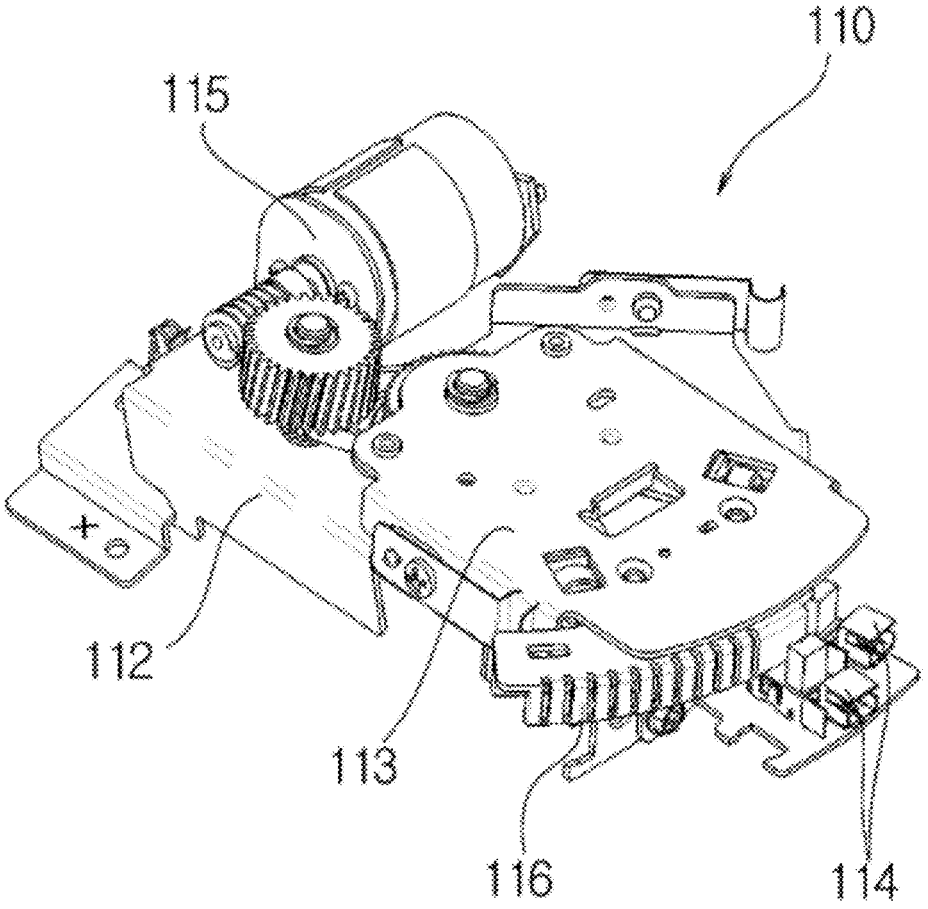
FIG. 7 is a partially perspective view showing a configuration of a sheet post-processing unit according to an embodiment of the present invention.

As shown in FIGS. 6 and 7, the stapler corresponding to the sheet post-processing unit 110 may include a stapler body 111 stapling the sheet stack P by pressing a staple against the sheet stack P, a motor 115 fixed to a fixed base 112 which is fixed to one side of a longitudinal transfer path, a rotary base 113 rotated about an axis through a rotating force of the motor 115 in a state of supporting the stapler body 111, and a sensor 114 detecting a rotation angle value of the rotary base 113, comparing the detected rotation angle value with a preset rotation angle value, and providing a basis for the motor 115 to be driven by the preset angle.

The sensor 114 may detect the rotation angle through detection of an encoder 116 installed in the rotary base 113.

The motor 115 may be a stepping motor or a servo motor so that the rotation angle value can be detected without the sensor 114.

Such a rotation angle value of the stapler as described above may be set through a manipulation unit (not shown) of the image forming apparatus 1, and rotation control of the stapler may be performed through a controller (not shown) including a microprocessor loaded with a comparison processing program for comparing the rotation angle value having been set in advance through the manipulation unit with the actual rotation angle value having been detected through the sensor 114, and determining whether or not the set rotation angle value coincides with the actual rotation angle value.

The number of the sheets of the sheet stack P which are discharged and stacked after images have been formed thereon in the image forming apparatus 1 may be set through a manipulation unit (not shown), and control for the set number of the sheets may be performed through a controller (not shown) which is installed in the image forming apparatus 1, and includes a microprocessor loaded with a comparison processing program for comparing the number of stacked sheets having been set in advance through the manipulation unit with the number of sheets having been counted by a sheet counter (not shown), and determining whether or not the set number of sheets coincides with the counted number of sheets.

A distance value by which the sheet stack transfer unit 120 intermittently transfers the sheet stack P toward the sheet post-processing unit 110 may be set through a manipulation unit (not shown), and control for the intermittent transfer distance value may be performed through a controller (not shown) including a microprocessor loaded with a comparison processing program for comparing the transfer distance value having been set in advance through the manipulation unit with a travel distance value of the sheet stack transfer unit 120, and determining whether or not the set transfer distance value coincides with the travel distance value.

The manipulation units may be unified, and the controllers may be unified. As an exemplary embodiment, the manipulation units and the controllers may be realized by a manipulation panel and a Central Processing Unit (CPU) of the image forming apparatus 1, respectively.

Figure 8:
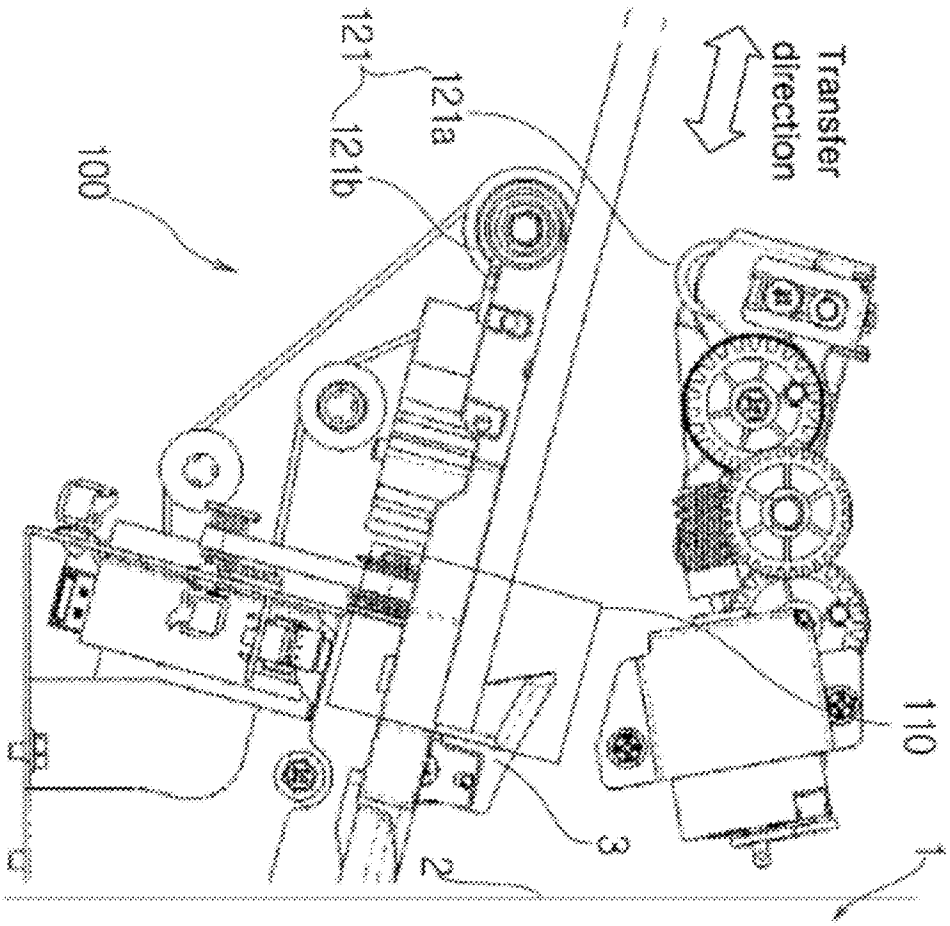
FIG. 8 is a side view showing a configuration (a transfer roller group) of a sheet stack transfer unit according to an embodiment of the present invention.

As shown in FIG. 8, the sheet stack transfer unit 120 may include an upper transfer roller 121 *a* which is located above the transfer path of the sheet stack P, and presses and releases an upper surface of the sheet stack P while being rotated in a state of being axially coupled to a gear train driven by a motor, and a lower transfer roller 121 *b* which is located on a lower surface of the sheet stack P, and transfers the sheet stack P interposed between the upper transfer roller 121 *a* and the lower transfer roller 121 *b*.

Figure 9:
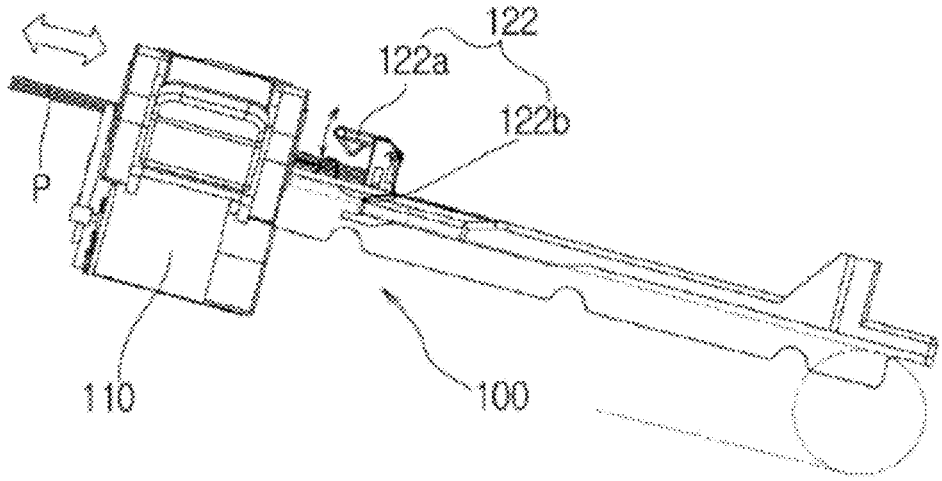
FIG. 9 is a side view showing a configuration (a gripper) of a sheet stack transfer unit according to an embodiment of the present invention.

Alternatively, as shown in FIG. 9, a sheet stack transfer unit 120 may include a gripper 122 having the following construction. That is, the gripper 122 may include a grip base 122 *b* engaged with a lead screw which is installed below the transfer path of the sheet stack P and rotated by a stepping motor, and a grip 122 *a* installed on the grip base 122 *b* and moving forward and rearward in a transfer direction while grasping the sheet stack P, or may include a grip base 122 *b* fixed on a timing belt which connects a driving pulley rotated by a stepping motor and a driven pulley, and a grip 122 *a* installed on the grip base 122 *b* and moving forward and rearward in a transfer direction while grasping the sheet stack P.

Figure 10:
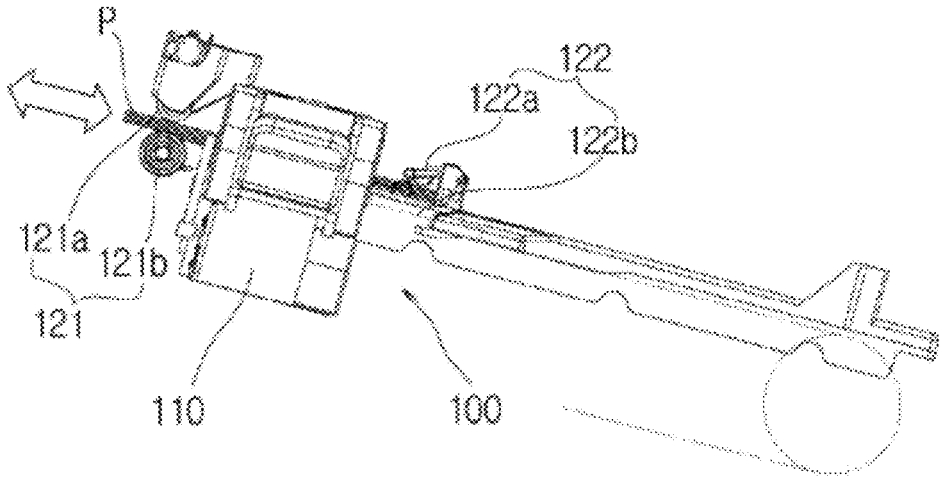
FIG. 10 is a side view showing a configuration (a transfer roller group and a gripper) of a sheet stack transfer unit according to an embodiment of the present invention.

Otherwise, as shown in FIG. 10, a sheet stack transfer unit 120 may include a transfer roller group 121, and any one of the following grippers. The transfer roller group 121 may include an upper transfer roller 121 *a* which is located above the transfer path of the sheet stack P, and presses and releases an upper surface of the sheet stack P while being rotated in a state of being axially coupled to a gear train driven by a motor, and a lower transfer roller 121 *b* which is located on a lower surface of the sheet stack P, and transfers the sheet stack P interposed between the upper transfer roller 121 *a* and the lower transfer roller 121 *b*. A gripper 122 may include a grip base 122 *b* engaged with a lead screw which is installed below the transfer path of the sheet stack P and rotated by a stepping motor, and a grip 122 *a* installed on the grip base 122 *b* and moving forward and rearward in a transfer direction while grasping the sheet stack P. Or, a gripper 122 may include a grip base 122 *b* fixed on a timing belt which connects a driving pulley rotated by a stepping motor and a driven pulley, and a grip 122 *a* installed on the grip base 122 *b* and moving forward and rearward in a transfer direction while grasping the sheet stack P.

Figure 11:
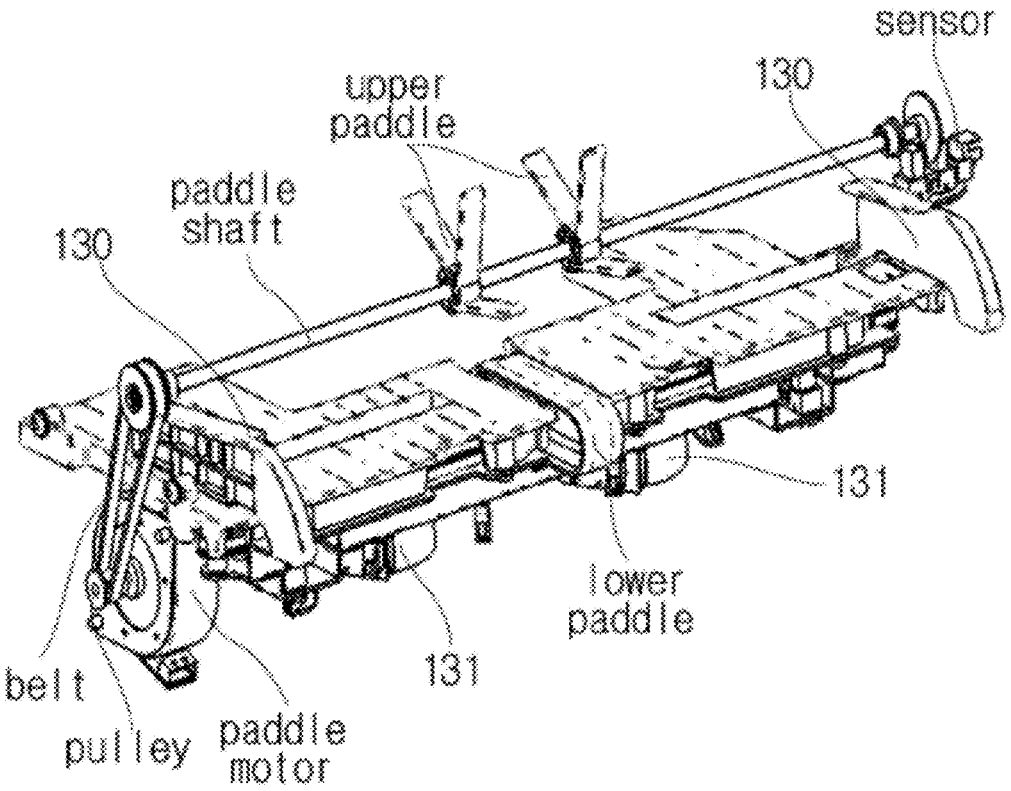
FIG. 11 is a perspective view showing a configuration of tampers according to an embodiment of the present invention.

Meanwhile, as shown in FIG. 11, the sheet post-processing apparatus 100 may further include tampers 130 installed between the discharge end 2 of the image forming apparatus 1 and the sheet post-processing unit 110, and grasping opposite ends of one side of a longitudinal direction of the arranged sheet stack P to move the sheet stack P to the transfer path on which the sheet post-processing unit 100 is located, when the number of the sheets which are discharged after images have been formed thereon reaches the preset number of the sheets.

The tampers 130, a pair of moving units situated at mutually symmetric locations with respect to the transfer direction of the sheet stack P, may be short-range location moving units pressing the opposite ends of the one side of the longitudinal direction of the sheet stack P to move the sheet stack P to the transfer path along guides by driving devices in which rotary members rotated by motors 131 are installed to be symmetric to each other. Since general tampers may be applied as they are, specific descriptions of the tampers will be omitted.

Although not shown, the rotary members may be a belt-pulley assembly in which a driving pulley rotated by the motor 131 and a driven pulley are connected by a timing belt, a gear train driven by the motor 131, or a combination of the belt-pulley assembly and the gear train.

The motors 131 may be driven in response to control signals output from the controller when the sheet stack P is stacked by the preset number of sheets.

Meanwhile, in the present invention, the transfer direction of the sheet stack P may correspond to a direction of a tray in which the sheet stack P is stacked in the form of a bundle while being stapled, a direction of the image forming apparatus 1 in which another process progresses, or a direction of a path along which the sheet stack P is transferred to another stacking tray.

Operations of the present invention including the above-described configuration will be described hereinafter.

Figure 12:
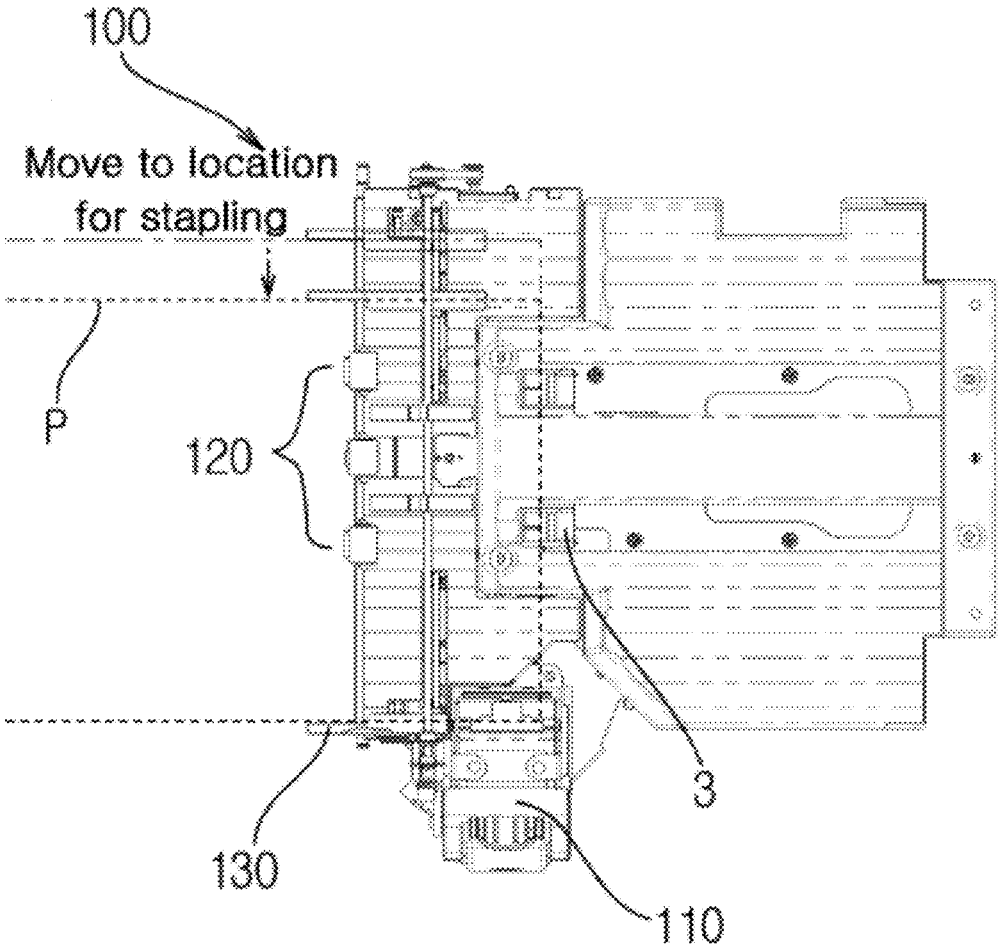
FIG. 12 is a plan view showing a movement state of a sheet stack by tampers according to an embodiment of the present invention.

First, as shown in FIG. 12, when sheets on which images have been formed in an image forming apparatus 1 are discharged and stacked by the preset number of sheets, tampers 130 move a sheet stack P to an initial location of a transfer path at which a sheet post-processing unit 110 is situated while grasping opposite ends of one side of a longitudinal direction of the sheet stack P.

A pair of the tampers 130 located to be symmetric to each other with respect to a transfer direction of the sheet stack P presses the opposite ends of the sheet stack P, and then moves the sheet stack P along guides to the initial location of the transfer path at which the sheet post-processing unit 110 is situated, through driving devices in which rotary members rotated by motors 131 are installed to be symmetric to each other.

Figure 13:
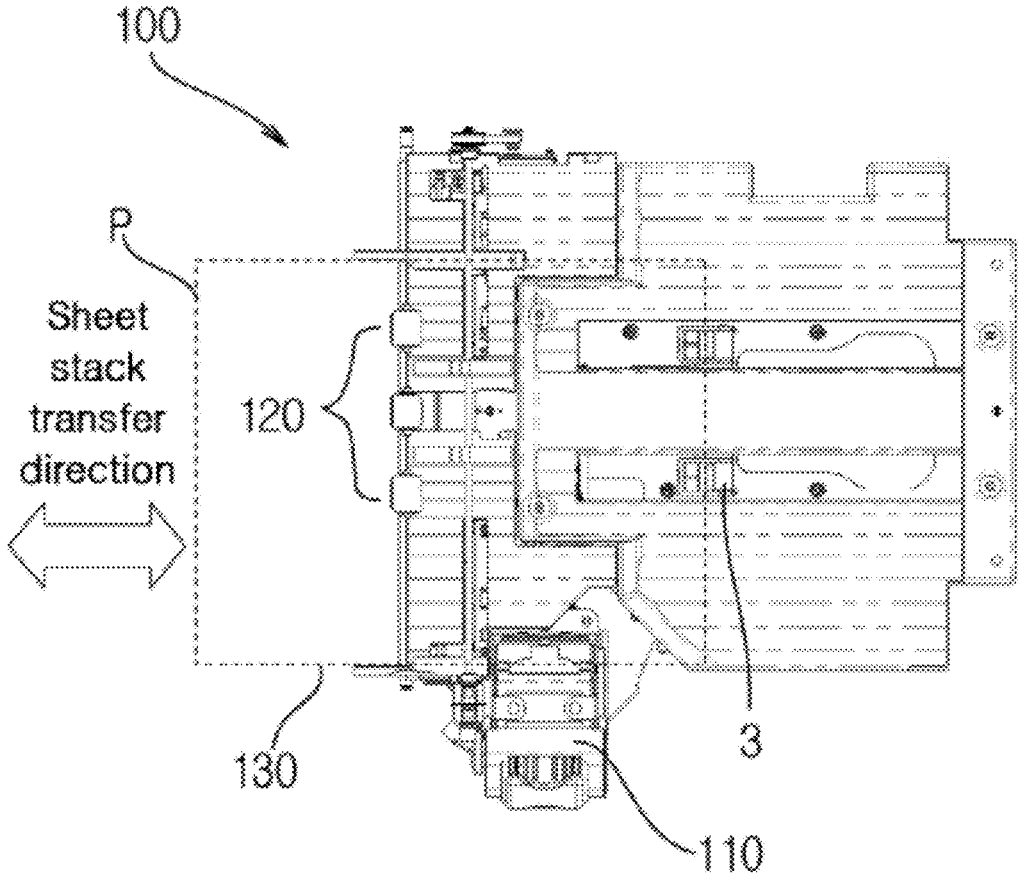
FIG. 13 is a plan view showing a movement state of a sheet stack by a sheet stack transfer unit according to an embodiment of the present invention.

In this state, as shown in FIG. 13, a sheet stack transfer unit 120 corresponding to a transfer roller group 121, a gripper 122, or a combination of the transfer roller group 121 and the gripper 122 transfers the sheet stack P along the transfer path, and is interlocked with an operation of the sheet post-processing unit 110.

That is, sheet stack transfer according to an embodiment of the present invention may be performed by the transfer roller group 121 including an upper transfer roller 121 *a* which is located above the transfer path of the sheet stack P, and presses and releases an upper surface of the sheet stack P while being rotated in a state of being axially coupled to a gear train driven by a motor, and a lower transfer roller 121 *b* which is located on a lower surface of the sheet stack P, and transfers the sheet stack P interposed between the upper transfer roller 121 *a* and the lower transfer roller 121 *b*, in which case, when transfer control signals are input from a controller, the upper and the lower transfer rollers 121 *a* and 121 *b* rotate while mutually pressing the sheet stack P to transfer the sheet stack P, and when post-processing control signals are input from the controller, the rotation of the lower transfer roller 121 *b* is stopped so that the transfer of the sheet stack P is interrupted.

Alternatively, sheet stack transfer according to another embodiment of the present invention may be performed by a gripper 122 including a grip base 122 *b* engaged with a lead screw which is installed below the transfer path of the sheet stack P and rotated by a stepping motor, and a grip 122 *a* installed on the grip base 122 *b* and moving forward and rearward in a transfer direction while grasping the sheet stack P, or a gripper 122 including a grip base 122 *b* fixed on a timing belt which connects a driving pulley rotated by a stepping motor and a driven pulley, and a grip 122 *a* installed on the grip base 122 *b* and moving forward and rearward in a transfer direction while grasping the sheet stack P, in which case the gripper 122 transfers the sheet stack P along the transfer path while grasping a leading end or a trailing end of the sheet stack P in the transfer direction.

The grasping operation may be performed by a fixing grip located below one longitudinal end of the sheet stack P, and a rotary grip pressing an upper surface of the longitudinal end of the sheet stack P toward the fixing grip to grasp the sheet stack P while being rotated by a small-sized motor, in which case the grasping operation is performed when a transfer control signal is input from the controller, and the stepping motor rotates in the transfer direction to move the gripper 122 so that a transfer operation is performed at the same time.

Otherwise, sheet stack transfer according to another embodiment of the present invention may be performed through pushing one longitudinal end portion of the sheet stack P by the transfer roller group 121, and pulling an opposite longitudinal end portion of the sheet stack P by the gripper 122.

The transfer roller group 121 can easily secure a space for a configuration, but has a low speed and arranging efficiency as compared with the gripper 122. On the other hand, the gripper 122 has a high speed and arranging efficiency, but requires much space for the configuration as compared with the transfer roller group 121. Accordingly, the transfer roller group 121 and the gripper 122 may be applied selectively or in combination according to specifications of the sheet post-processing unit 110.

Figure 14:
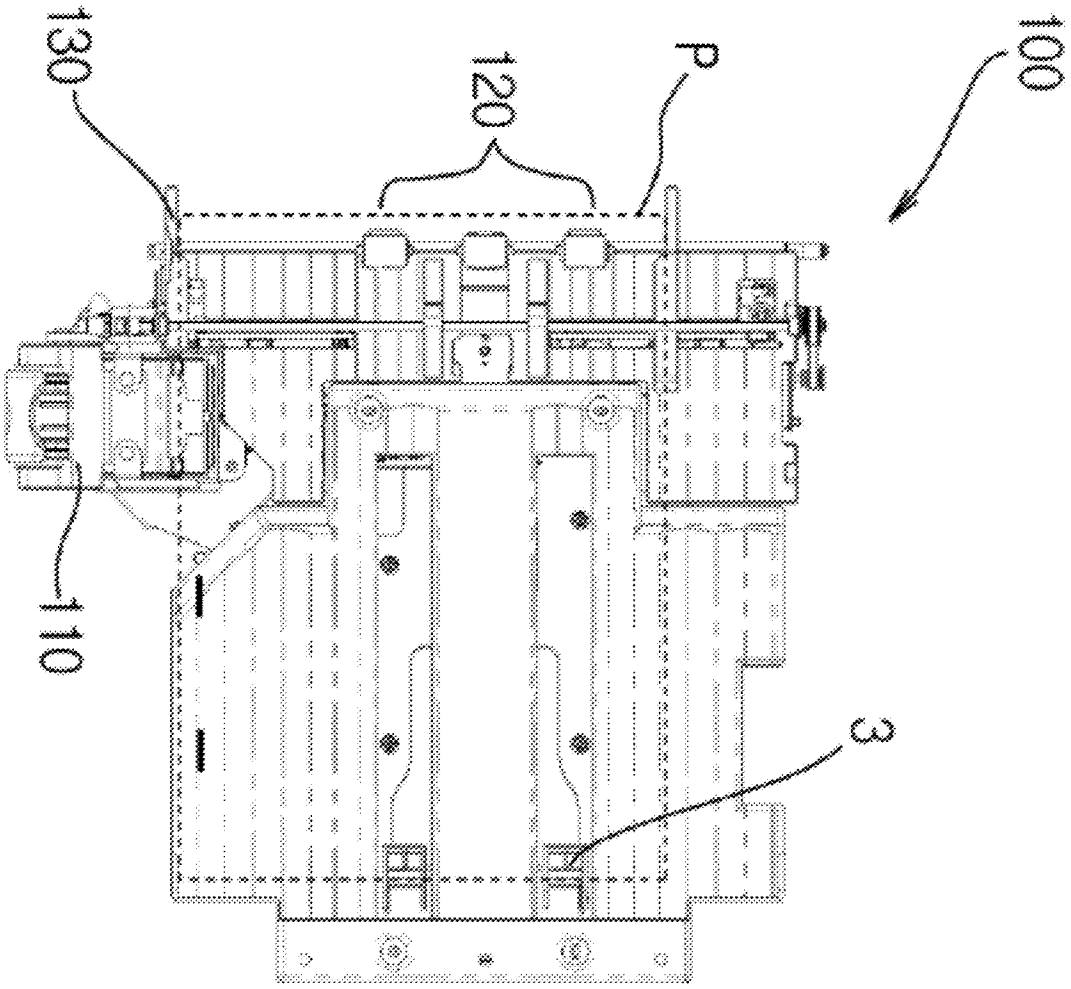
FIG. 14 is a plan view showing a post-processing state of a sheet stack by a sheet post-processing unit according to an embodiment of the present invention.

As shown in FIG. 14, in a state in which the sheet stack transfer unit 120 temporarily stops while intermittently transferring the sheet stack P by a preset interval, the sheet post-processing unit 110 located at one side of the longitudinal transfer path performs post-processing (stapling) of the sheet stack P.

As described above, the sheet post-processing unit 110 is located at the one side of the longitudinal transfer path along which the sheet stack P is transferred, and performs the post-processing (stapling) while the arranged sheet stack P is intermittently transferred through the sheet stack transfer unit 120, so that multipoint binding can be performed in the longitudinal direction of the sheet stack P although the image forming apparatus transfers and discharges the sheets only in the longitudinal direction (a lengthwise direction of the sheets), which makes it possible to bind the sheets like a book.

Moreover, the sheet post-processing unit 110 is stationarily installed at a predetermined location of the transfer path to perform the post-processing in the process of transferring the sheet stack P through the sheet stack transfer unit 120 so that stability and accuracy can be secured according to the operation of the sheet post-processing unit 110.

Figure 15:
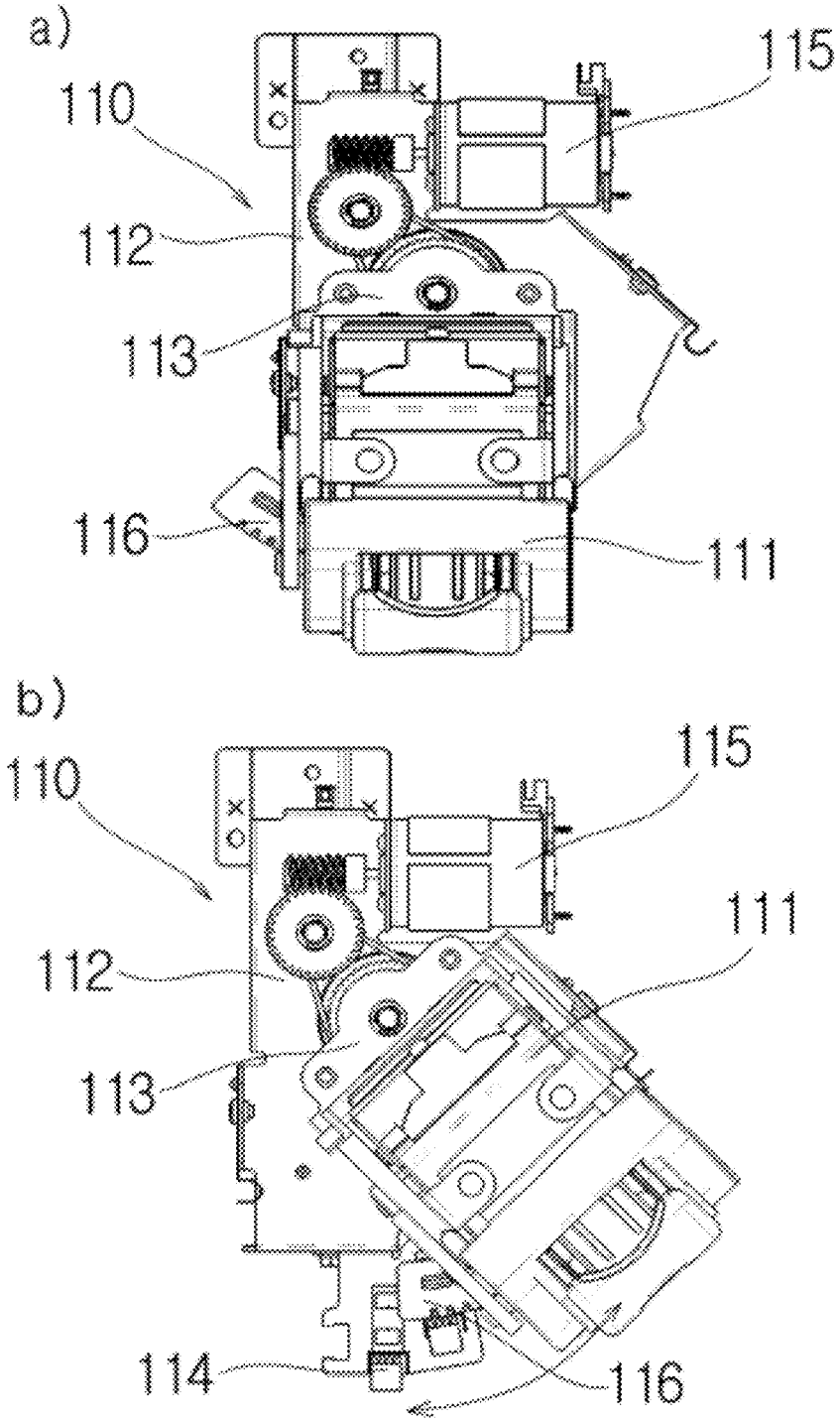
FIG. 15 shows plan views exemplifying a rotating state of a sheet post-processing unit according to an embodiment of the present invention.

As shown in FIG. 15, a rotary base 113 rotating about an axis while supporting a stapler body 111 is rotated according to a preset angle value by a motor 115 on a fixed base 112 installed at one side of a longitudinal transfer path of a sheet stack P, in a sheet post-processing unit 110, that is, a stapler.

A controller compares a preset rotation angle value with an actual rotation angle value of the rotary base 113 which is acquired through detection of a sensor 114, and when the actual rotation angle value coincides with the preset rotation angle value, for example, an angle of 45 degrees, stops the motor 115 so that the rotation of the rotary base 113 is interrupted.

Figure 16:
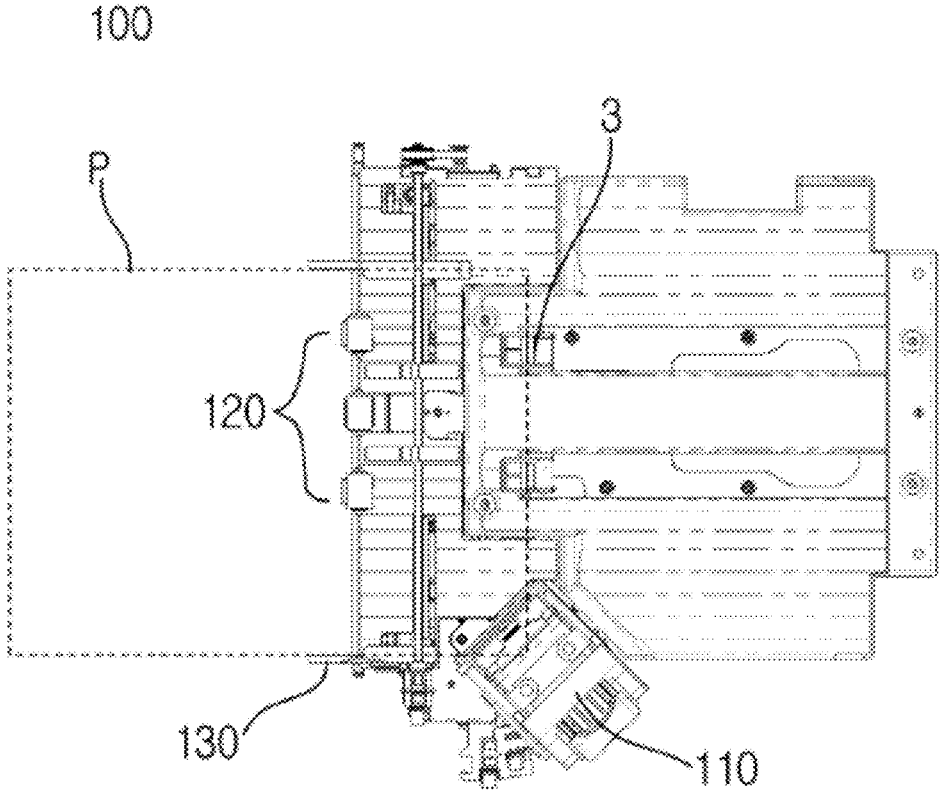
FIG. 16 is a plan view showing a post-processing state of a sheet stack while a sheet post-processing unit is rotated according to an embodiment of the present invention.

Thereafter, as shown in FIG. 16, in the state in which the sheets are arranged, the sheet post-processing unit 110, that is, the stapler staples one side of a longitudinal leading end of the arranged sheet stack P at the angle of 45 degrees.

As described above, in the state of being stationary at the predetermined location in the longitudinal direction in which the sheet stack P is transferred, the sheet post-processing unit 110 is rotated through a minimal movement, and then performs multipoint binding or one-point binding so that a space can be minimally made for installation and an operation of the sheet post-processing unit 110.

Figure 17:
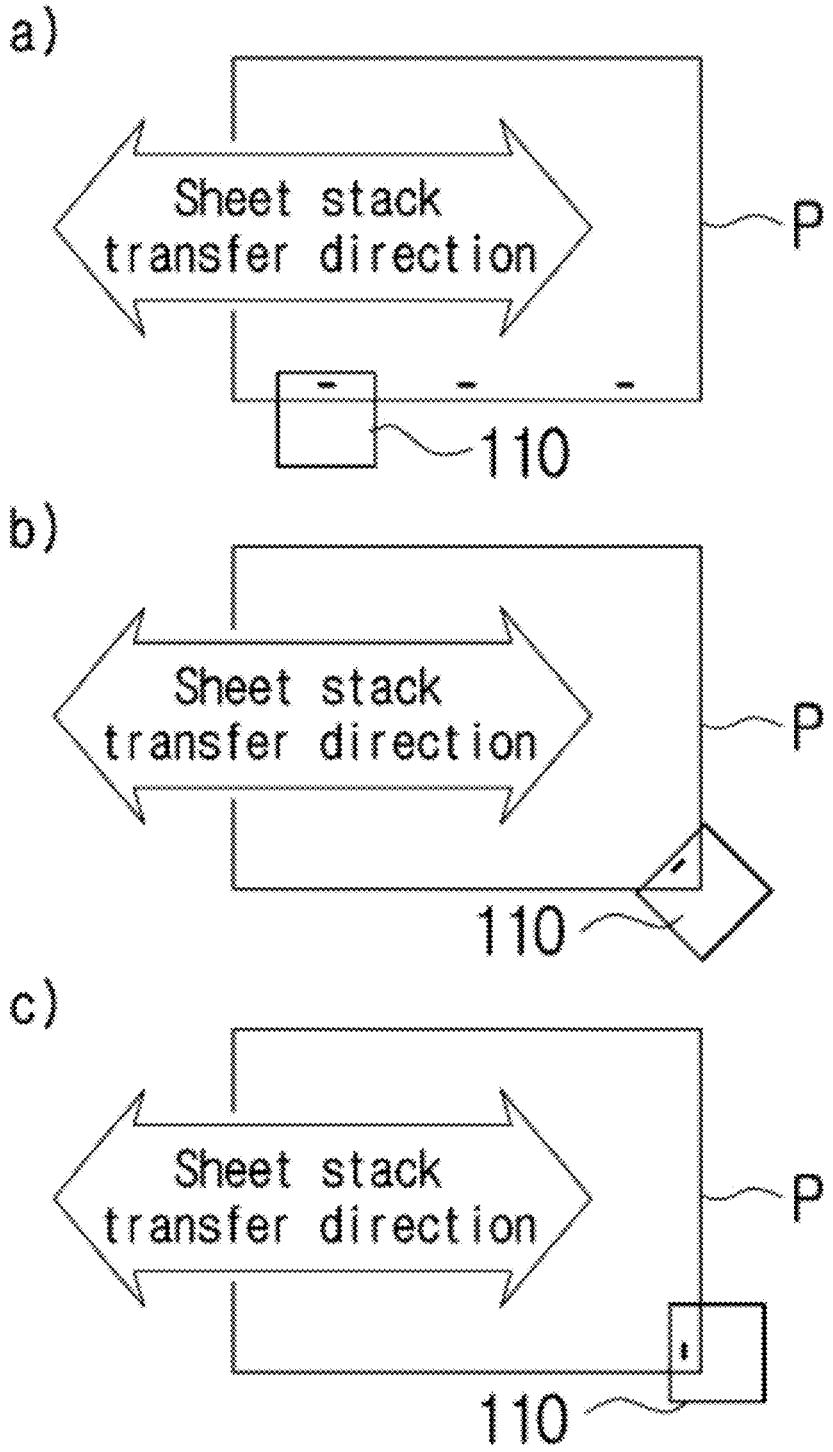
FIG. 17 shows plan views exemplifying stapled states of sheet stacks according to embodiments of the present invention.

According to the embodiments of the present invention described above, the sheet stack P is post-processed, that is, stapled as follows. As shown in FIG. 17A, multipoint binding may be formed in a line at a predetermined interval in a longitudinal direction of one side of the sheet stack P. As shown in FIG. 17B, one-point binding may also be formed at the angle of 45 degrees at the one side of the longitudinal leading end of the sheet stack P. As shown in FIG. 17C, one-point binding may also be formed at the angle of 90 degrees at the one side of the longitudinal leading end of the sheet stack P.

Reference numeral 3 in the accompanying drawings denotes a sheet arranging unit installed at the outside of the discharge end 2 of the longitudinal discharge type image forming apparatus 1, and arranging the discharged sheets.

Although the present invention has been described and shown in the drawings in regard to the exemplary embodiments for exemplifying a principle of the present invention, the present invention is not limited to such a configuration and an operation as described above as they are.

Moreover, it will be understood by those skilled in the art that various changes and modifications can be made without departing from the spirit and the scope of the invention as disclosed in the accompanying claims.

Accordingly, all such changes and modifications, and their equivalents should be considered to be within the spirit and scope of the present invention.

What is claimed is:

1. An apparatus for post-processing sheets which is installed at a discharge end of a longitudinal discharge image forming apparatus, the sheet post-processing apparatus comprising:

a roller which transfers a sheet stack discharged from the discharge end in a first direction and stacked as many as a preset number of sheets in a second direction opposite to the first direction;

a sheet arranging unit which supports a transverse one end of the sheet stack, and, together with the roller, transfers the sheet stack in the second direction; and a sheet post-processing unit which performs post-processing several times in parallel with a longitudinal one end of the sheet stack which is transferred in the second direction by the roller and the sheet arranging unit, wherein the sheet post-processing unit is disposed between the roller and the sheet arranging unit, wherein the roller and the sheet arranging unit transfer the sheet stack post-processed several times by the sheet post-processing unit in the first direction, and wherein the sheet arranging unit comprises a gripper grasping the sheet stack.

2. The apparatus for post-processing sheets of claim 1, wherein a plurality of the sheet arranging units are provided and wherein the plurality of sheet arranging units are disposed apart from each other and are interlocked together.

3. The apparatus for post-processing sheets of claim 1, further comprising a tamper which arranges opposite longitudinal ends of the sheet stack.

4. The apparatus for post-processing sheets of claim 3, wherein the tamper transfers the sheet stack in a third direction perpendicular to the second direction, and wherein the sheet arranging unit guides the transverse one end of the sheet stack when the sheet stack is transferred in the third direction.

5. The apparatus for post-processing sheets of claim 3, wherein the roller comprises a lower roller which is located on the sheet stack and an upper roller which is located above the sheet stack, and wherein the upper and the lower rollers transfer the sheet stack in the second direction while mutually pressing the sheet stack.

6. The apparatus for post-processing sheets of claim 3, further comprising an upper paddle which transfers, to the sheet arranging unit, the traverse one end of the sheet stack discharged from the discharge end in the first direction.

7. An apparatus for post-processing sheets which is installed at a discharge end of a longitudinal discharge image forming apparatus, the sheet post-processing apparatus comprising:

an inner tray which supports a portion of a sheet which includes a transverse one end of the sheet discharged from the discharge end in a first direction;

a tamper which is mounted on the inner tray and arranges opposite longitudinal ends of the sheet disposed on the inner tray;

a sheet post-processing unit which is mounted on one side of the inner tray and performs post-processing on a sheet stack which has been disposed on the inner tray and then arranged by the tamper; and a roller which is mounted on the inner tray and causes the sheet stack post-processed by the sheet post-processing unit to be discharged in the first direction, wherein the tamper is disposed between the roller and the sheet post-processing unit, wherein the apparatus further comprises a sheet arranging unit which is mounted in the inner tray and performs a reciprocating movement on the inner tray in the first direction and in a third direction opposite to the first direction, wherein the sheet arranging unit supports a traverse one end of the sheet stack, and, together with the roller, transfers the sheet stack in the first direction or in the third direction, and wherein the sheet arranging unit comprises a gripper grasping the sheet stack.

8. The apparatus for post-processing sheets of claim 7, wherein the tamper transfers the sheet stack disposed on the inner tray in a direction of the sheet post-processing unit.

9. The apparatus for post-processing sheets of claim 8, wherein the tamper presses the opposite longitudinal ends of the sheet stack and transfers the sheet stack in the direction of the sheet post-processing unit.

10. The apparatus for post-processing sheets of claim 8, wherein the tamper transfers the sheet stack in a second direction perpendicular to the first direction.

11. The apparatus for post-processing sheets of claim 7, wherein a plurality of the sheet arranging units are mounted in the inner tray, and the plurality of sheet arranging units support the traverse one end of the sheet stack, respectively.

12. The apparatus for post-processing sheets of claim 7, further comprising an upper paddle which transfers, to the sheet arranging unit, the traverse one end of the sheet stack discharged from the discharge end in the first direction.

13. The apparatus for post-processing sheets of claim 7, further comprising a move roller which is disposed on the roller, presses the sheet stack placed on the roller, and, together with the roller, transfers the sheet stack.

* * * * *